US007408104B2

(12) United States Patent
Sato

(10) Patent No.: US 7,408,104 B2
(45) Date of Patent: Aug. 5, 2008

(54) PEDAL DEVICE FOR DRUM

(75) Inventor: Naoki Sato, Aichi (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 300 days.

(21) Appl. No.: 11/234,449

(22) Filed: Sep. 23, 2005

(65) Prior Publication Data

US 2007/0006715 A1 Jan. 11, 2007

(30) Foreign Application Priority Data

Jul. 8, 2005 (JP) ..... 2005-200848

(51) Int. Cl.
*G10D 13/02* (2006.01)

(52) U.S. Cl. ..... 84/422.1; 84/746

(58) Field of Classification Search ..... 84/422.1, 84/746; D17/22
See application file for complete search history.

(56) References Cited

U.S. PATENT DOCUMENTS 2,027,869 A 1/1936 La Londe ..... 84/422
4,744,279 A * 5/1988 Livingston ..... 84/746
2002/0121177 A1* 9/2002 Sassmannshausen ..... 84/422.1

FOREIGN PATENT DOCUMENTS

| | | |
|---|---|---|
| JP | 63-54198 | 4/1988 |
| JP | 63-80600 | 5/1988 |
| JP | 3054743 | 9/1998 |
| JP | 2003-195857 | 7/2003 |
| JP | 2004-334008 | 11/2004 |

OTHER PUBLICATIONS

Japanese Office Action, dated Jun. 19, 2007, 4 pages.
Prior Art Information List.

* cited by examiner

*Primary Examiner*—Lincoln Donovan
*Assistant Examiner*—Jianchun Qin
(74) *Attorney, Agent, or Firm*—Ostrolenk, Faber, Gerb & Soffen, LLP

(57) ABSTRACT

A pedal device for a drum includes a base plate, a pedal, a chain, a pivot shaft, a beater, and an extension coil spring. When the pedal is freed from a depressed state, the urging force of the extension coil spring returns the beater from an operation position to a suspended position and returns the pedal to a standby position. A compression coil spring is arranged between the pedal and the base plate.

14 Claims, 7 Drawing Sheets

PEDAL DEVICE FOR DRUM

BACKGROUND OF THE INVENTION

The present invention relates to a pedal device used when playing a drum such as a bass drum.

With reference to FIG. 11, a pedal device 100 includes a base plate 101, a pedal 102, a chain 103, a pivot shaft 104, a beater 105, and an extension coil spring 110. Two arms 107 project upward from the front portion of the base plate 101. The two arms 107 pivotally support the pivot shaft 104. The beater 105 and a wheel 108 are attached to the pivot shaft 104. The pedal 102 is pivotally attached to a rear portion of the base plate 101 by a support shaft 106. The chain 103 connects the pivot shaft 104 and the pedal 102. The chain 103 is wound on the wheel 108. In this state, one end of the chain 103 is fixed to the wheel 108, and the other end of the chain 103 is fixed to a movable end of the pedal 102. The extension coil spring 110 is connected between a cam 111, which is connected to the pivot shaft 104, and an adjustment screw 112, which is located at the outer side of the arms 107.

In the pedal device 100, when the pedal 102 is not operated, the extension coil spring 110 holds the beater 105 at a suspended position P1 and the pedal 102 at a standby position F1, as shown in the state of FIG. 11 by solid lines. When the pedal 102 is depressed against the urging force of the extension coil spring 110, the chain 103, the wheel 108, and the pivot shaft 104 pivots the beater 105 from the suspended position P1 to an operation position P3, which is shown by the broken lines, to beat a bass drum (not shown). When the pedal 102 is freed, the urging force of the extension coil spring 110 returns the beater 105 from the operation position P3 to the suspended position P1, and the pedal 102 to the standby position F1. In the pedal device 100 of the prior art, the position of the adjustment screw 112 is adjusted in the vertical direction to vary the urging force of the extension coil spring 110. This sets the feel of pedal depression or sets the return speed of the beater 105 to a predetermined speed.

When playing the bass drum, a drummer depresses the pedal 102 with his or her foot and then frees the pedal 102 to pivot the beater 105 in a reciprocating manner. The drummer quickly lifts his or her foot to free the pedal 102 when successively beating the drum. In such a case, the drummer's foot may instantaneously be separated from the pedal 102. Thus, the pedal 102 would not follow the movement of the drummer's foot. This may hinder with the playing of the bass drum. To solve such a problem, the return speed of the pedal 102 may be increased by increasing the urging force of the extension coil spring 110, reducing the weight of the pedal 102 or beater 105, or enlarging the diameter of the wheel 108.

However, an increase in the urging force of the extension coil spring 110 would increase the force required by the drummer to depress the pedal 102. Further, an enlargement of the diameter of the wheel 108 would decrease the pivoting amount of the pivot shaft 104 with respect to the depression amount of the pedal 102 and thus reduce the pivoting amount (pivoting angle) of the beater 105. Accordingly, an increase in the urging force of the extension coil spring 110 or an enlargement of the diameter of the wheel 108 would lower the movability of the pedal 102 or slow the movement of the beater 105. This would make it difficult to play the bass drum. Further, to reduce the weight of the pedal 102, light steel such as titanium would have to be used from the viewpoint of durability. However, this would increase the material cost and be an obstacle to lowering the cost of the pedal device 100.

Moreover, if the weight of the beater 105 is reduced, the desired loudness may not be obtained when beating the bass drum.

SUMMARY OF THE INVENTION

It is an object of the present invention to provide a pedal device that increases the return speed of the pedal and makes a drum easier to play.

One aspect of the present invention is a pedal device used to play a drum. The pedal device includes a base. A beater, pivotally supported by the base, pivots between an operation position for beating a drum and a suspended position separated from the drum. A pedal pivotally supported by the base operates the beater. The pedal is located at a standby position that is separated from the base when in a free state and is located at a position that is close to the base when in a depressed state. A connection member connects the pedal and the beater. A first urging member for holding the beater at the suspended position and the pedal at the standby position when the pedal is in the free state. The beater is pivoted from the suspended position to the operation position against urging force of the first urging member when the pedal is depressed. The urging force of the first urging member returns the beater to the suspended position from the operation position and the pedal to the standby position when the pedal is freed. A second urging member urges the pedal away from the base. The second urging member adds urging force to the urging force of the first urging member when the beater returns to the suspended position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to FIGS. 1 to 5.

Figure 1:
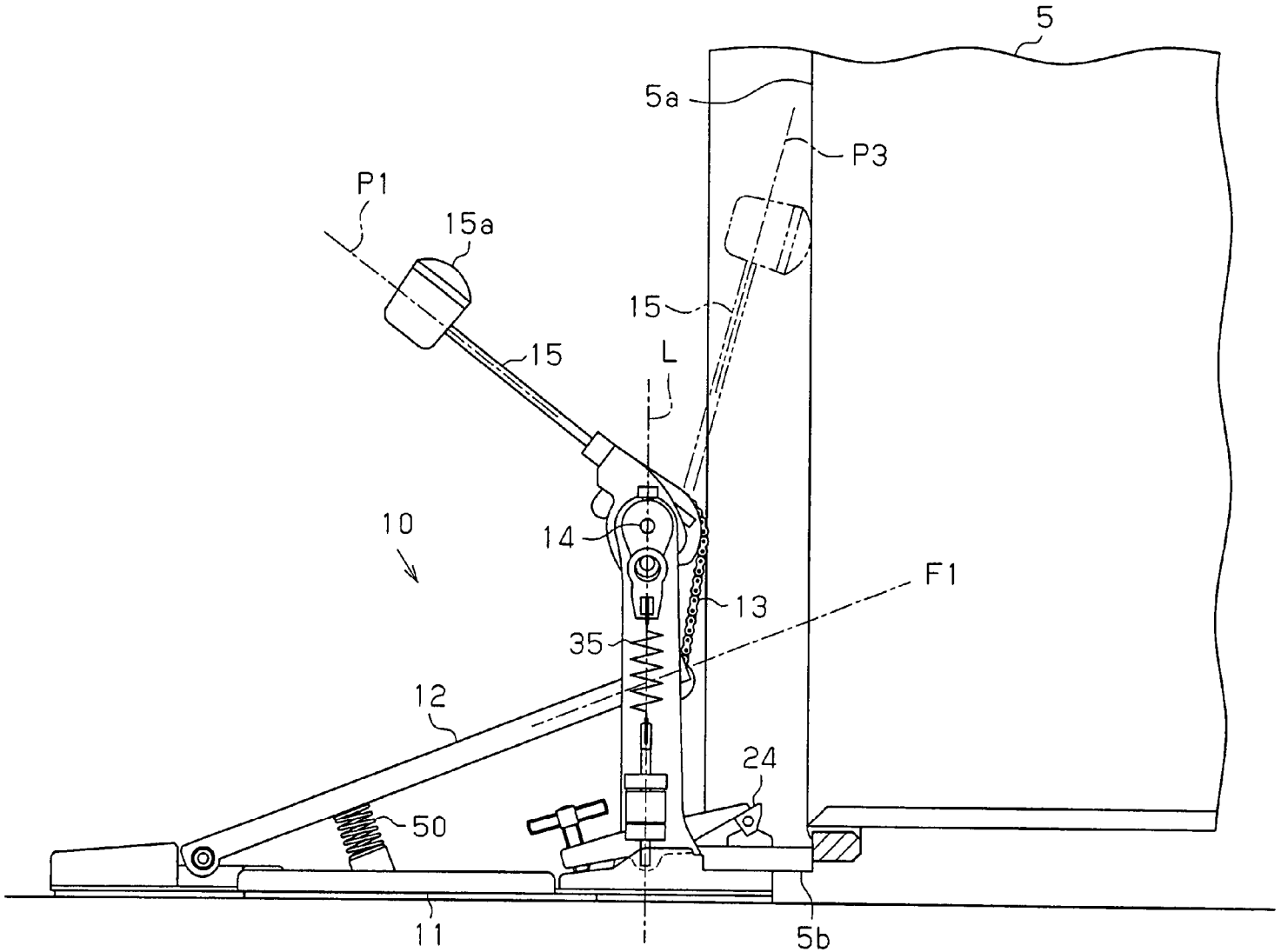
FIG. 1 is a side view showing a pedal device according to a preferred embodiment of the present invention, with the pedal device connected to a bass drum.

Referring to FIG. 1, a pedal device 10 includes a base plate 11, a pedal 12, a chain 13, a pivot shaft 14, a beater 15, and an extension coil spring 35. The pedal device 10 is used in a state in which the base plate 11, which functions as a base, is connected to a bass drum 5, with a beating surface 15*a* of the beater 15 facing toward the bass drum 5. When playing the bass drum 5 with the pedal device 10, a drummer depresses or raises the pedal 12 with his or her foot to pivot the beater 15 in a reciprocating manner together with the pivot shaft 14. In the description of the pedal device 10, the side connected to the bass drum 5 (right side as viewed in FIG. 1) is referred to as a front portion, and the side opposite from the bass drum 5 (left side as viewed in FIG. 1) is referred to as a rear portion.

Figure 2:
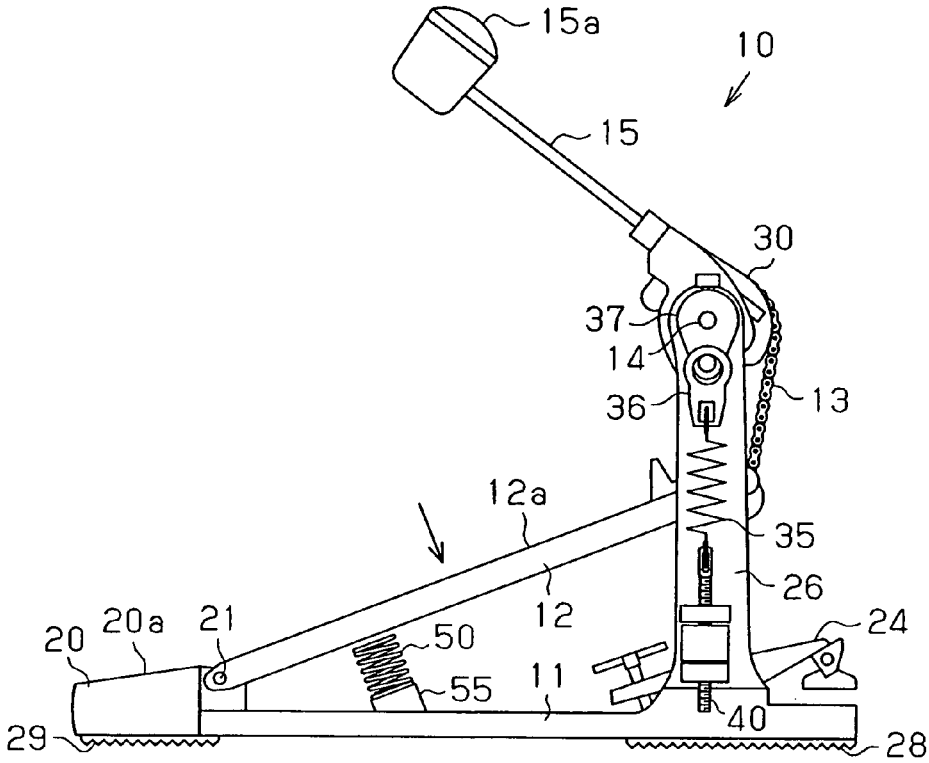
FIG. 2 is a side view showing the entire structure of the pedal device.
Figure 3:
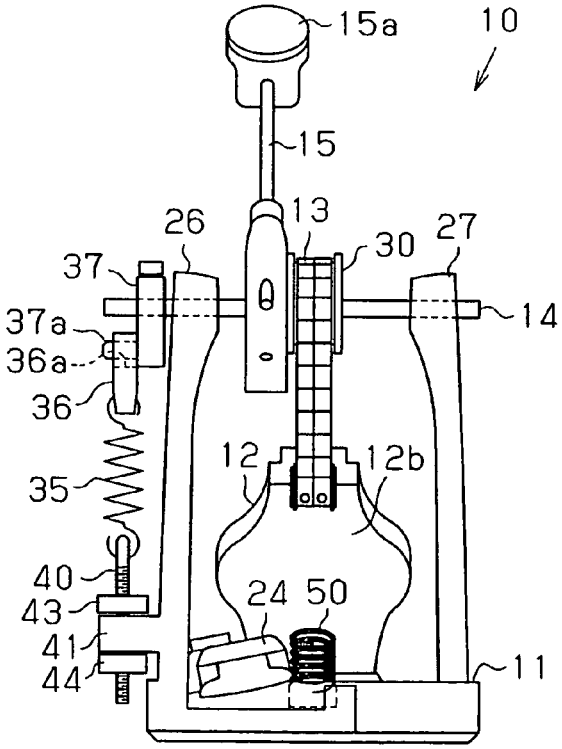
FIG. 3 is a front view showing the pedal device.

Referring to FIGS. 2 and 3, the pedal device 10 includes a base plate 11. A heel rest 20 is attached to the rear end portion of the base plate 11. The heel rest 20 has a flat upper surface 20*a*. The drummer places the heel of his or her foot on the upper surface 20*a* (refer to FIG. 5(A)). The rear end of the pedal 12 is pivotally attached to the heel rest 20 by a support shaft 21. The drummer places the rest of his or her foot on the pedal 12, which is flat (refer to FIG. 5(A)).

A clamp 24 is attached to the front end portion of the base plate 11 to connect the pedal device 10 to the bass drum 5. Two arms 26 and 27, which are spaced from each other by a predetermined distance, extend upward from the front end portion of the base plate 11. A pivot shaft 14 is pivotally supported by upper end portions of the arms 26 and 27. Two rubber stoppers 28 and 29, which are spaced from each other by a predetermined distance, are adhered to the lower surface of the base plate 11.

A beater 15 and a wheel 30 are attached to the generally middle part of the pivot shaft 14 above the base plate 11. The wheel 30 is generally disk-shaped and has a peripheral portion. One end of the chain 13 is wound around and fixed to the peripheral portion, and the other end of the chain 13 is fixed to the front end or movable end of the pedal 12.

Figure 4:
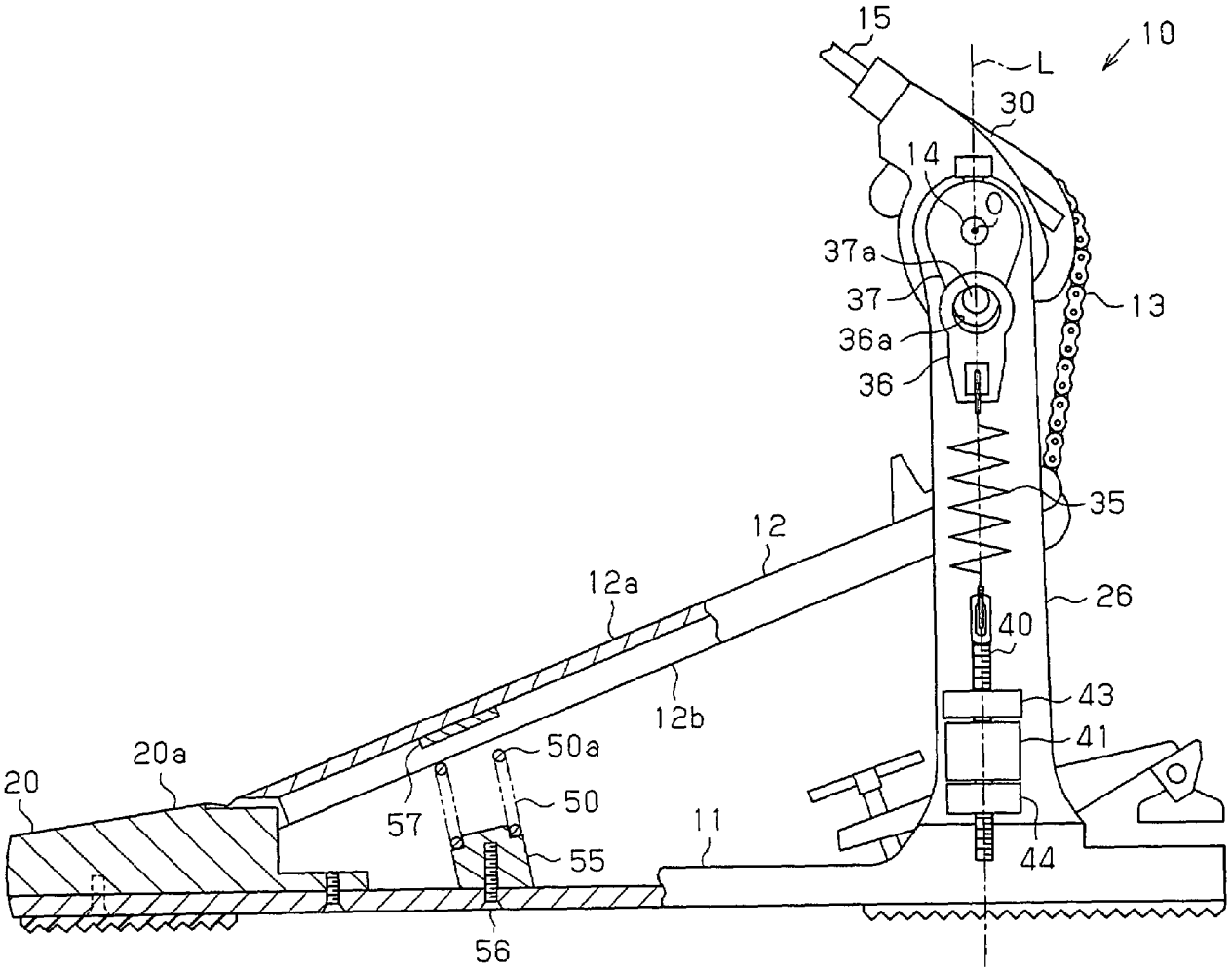
FIG. 4 is a partially cutaway view showing an attachment structure for a compression coil spring.

An extension coil spring 35 is arranged at the outer side of the arm 26. As shown in FIGS. 3 and 4, a connection ring 36 connects the upper end of the extension coil spring 35 to a cam 37, which is connected to the pivot shaft 14. The lower end of the extension coil spring 35 is connected to an adjustment screw 40, which is located on the lower portion of the arm 26.

The cam 37 includes a support pin 37*a*, which is inserted through a support hole 36*a* of the connection ring 36 to support the connection ring 36. The upper end of the extension coil spring 35 is hooked to the connection ring 36.

A fastening block 41 having a hole (not shown), through which the adjustment screw 40 is inserted, is formed integrally with the lower portion of the arm 26. The adjustment screw 40 is inserted through the hole of the fastening block 41. A nut 44 is mated with the adjustment screw 40 from the lower side thereof. The nut 44 is rotated about its axis to adjust the position of the adjustment screw 40 in the axial direction. A nut 43 is fastened with the adjustment screw 40 from the upper side thereof to lock the adjustment screw 40 at a certain position in the axial direction.

The lower end of the extension coil spring 35 is hooked to the upper end of the adjustment screw 40. In a state in which the axis L of the extension coil spring 35 is substantially aligned with the support pin 37*a* and the axis O of the pivot shaft 14, the extension coil spring 35 holds the beater 15 at the suspended position P1 and the pedal 12 at the standby position F1 (refer to FIG. 1). Accordingly, the urging force of the extension coil spring 35 may be varied in accordance with the position of the adjustment screw 40 in the axial direction. The varying of the urging force enables adjustment of the feel of the pedal 12 when the drummer depresses the pedal 12 and adjustment of the return speed of the beater 15 when the drummer frees the pedal 12.

When the pedal device 10 is configured as described above, after the drummer lifts his or her foot to free the pedal 12, the drummer's foot may be separated from the pedal 12. In such a case, the pedal 12 would not move in a manner following the movement of the drummer's foot. To solve this problem, in the pedal device of the preferred embodiment, a compression coil spring 50 is provided in addition to the extension coil spring 35 to increase the return speed of the pedal 12.

As shown in FIGS. 3 and 4, the compression coil spring 50 is arranged between the pedal 12 and the base plate 11. The compression coil spring 50 is arranged in the generally middle part of the base plate 11 with respect to the lateral direction and in the generally middle part of the base plate 11 with respect to the longitudinal direction (slightly toward the rear from a longitudinally middle position). When the pedal 12 is depressed the maximum amount and the pedal 12 is located at an operation position P3, the compression coil spring 50 is arranged so that its axis C1 is perpendicular to the upper surface 12*a* of the pedal 12 (refer to FIG. 5(C)).

Further, a cylindrical boss 55 for receiving the compression coil spring 50 is fixed to the base plate 11. A fastening screw 56 is inserted through the base plate 11 from the lower side to fasten the boss 55 to the base plate 11. To enable the compression coil spring 50 to be arranged as described above, the boss 55 is attached to the base plate 11 at a predetermined position and inclined at a predetermined angle. The compression coil spring 50 is detachably fitted to the upper end of the boss 55.

The urging force of the compression coil spring 50 is set so that it is smaller than the load produced by the pedal 12. Further, the compression coil spring 50 is arranged so that its upper end 50*a* is spaced from a lower surface 12*b* of the pedal 12 and does not contact the pedal when the pedal 12 is in a free state and not depressed, that is, when the pedal 12 is located at the standby position F1.

An absorber 57 is adhered to the lower surface 12*b* of the pedal 12 at a position facing towards the upper end 50*a* of the compression coil spring 50. The absorber 57 is sheet-like and has an outer diameter greater than that of the compression coil spring 50. The absorber 57 dampens the impact and noise produced when the pedal 12 meets the compression coil spring 50. The absorber 57 is made of a material having a cushioning property such as felt, cotton, cloth, sponge, or rubber.

The operation of the compression coil spring 50 will now be described with reference to FIGS. 5(A) to 5(C).

Figure 5A:
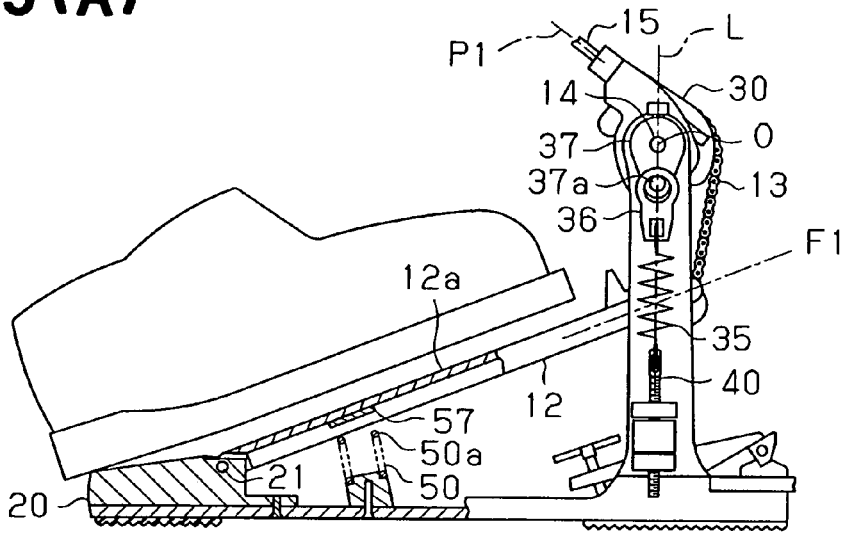
FIG. 5(A) is a partially cutaway view showing a pedal in a state prior to depression.

Referring to FIG. 5(A), when the pedal 12 is in a free state and not depressed, the extension coil spring 35, the adjustment screw 40, the axis of the support pin 37*a*, and the axis O of the pivot shaft 14 are substantially aligned along the same line. This restricts the pivoting of the pivot shaft 14, holds the pedal 12 at the standby position F1, and holds the beater 15 at the suspended position P1. In this state, the upper end 50*a* of the compression coil spring 50 is spaced from the lower surface 12*b* of the pedal 12. Thus, the urging force of the compression coil spring 50 is not applied to the pedal 12.

Figure 5B:
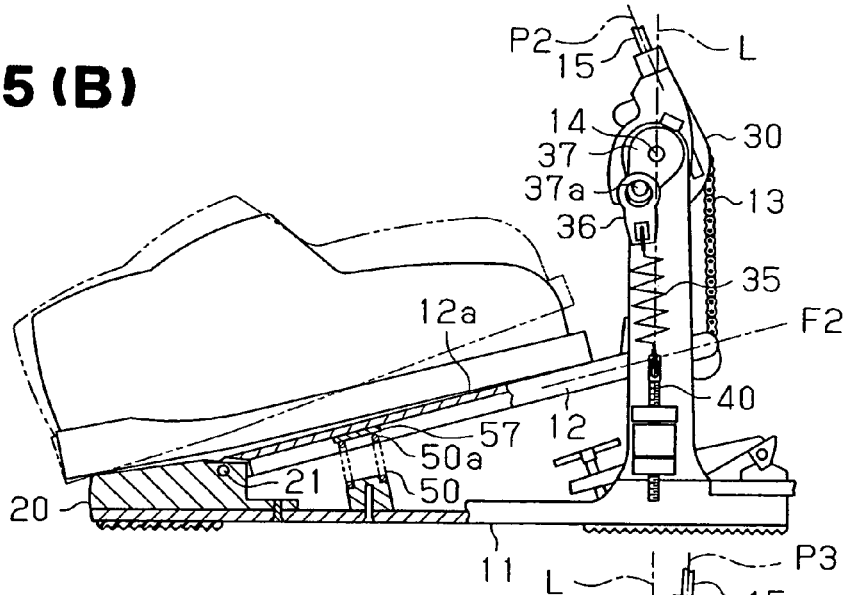
FIG. 5(B) is a partially cutaway view showing the pedal in a state after depression starts.

Referring to FIG. 5(B), when the pedal 12 is depressed from the standby position F1 to an intermediate position F2, in which the absorber 57 contacts with the upper end 50*a* of the compression coil spring 50, the chain 13 pivots the beater 15 with the wheel 30 and the pivot shaft 14 in the clockwise direction as viewed in the drawing. This moves the beater 15 from the suspended position P1 to an intermediate position P2.

Figure 5C:
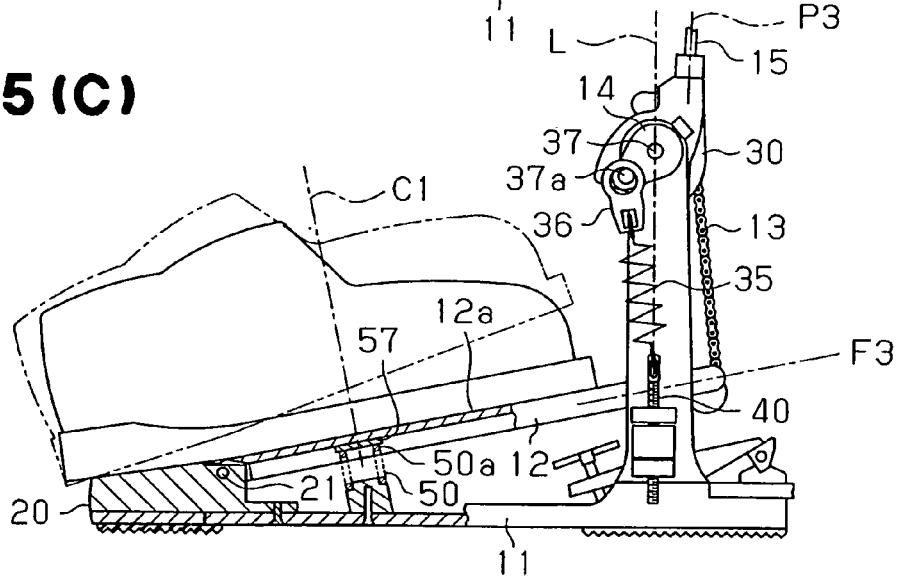
FIG. 5(C) is a partially cutaway view showing the pedal in a state in which the depression amount is maximum.

Referring to FIG. 5(C), as the pedal 12 is further depressed to the maximum depression position F3, the chain 13 pivots the beater 15 with the wheel 30 and the pivot shaft 14 to the operation position P3. This beats a beat surface 5*a* of the bass drum 5 with the beating surface 15*a* of the beater 15 (refer to FIG. 1).

As the pedal 12 is depressed, the pivot amount of the cam 37 increases, the extension coil spring 35 gradually expands, and the urging force of the extension coil spring 35 increases. After the pedal 12 contacts the compression coil spring 50, the compression coil spring 50 is gradually compressed. This increases the urging force of the compression coil spring 50.

When the drummer frees the pedal 12, the urging force of the extension coil spring 35 returns the beater 15 from the operation position P3 to the suspended position P1 with the connection ring 36, the cam 37, and the pivot shaft 14. The urging force of the extension coil spring 35 is also applied to the pedal 12 via the connection ring 36, the cam 37, the pivot shaft 14, the wheel 30, and the chain 13.

Figure 11:
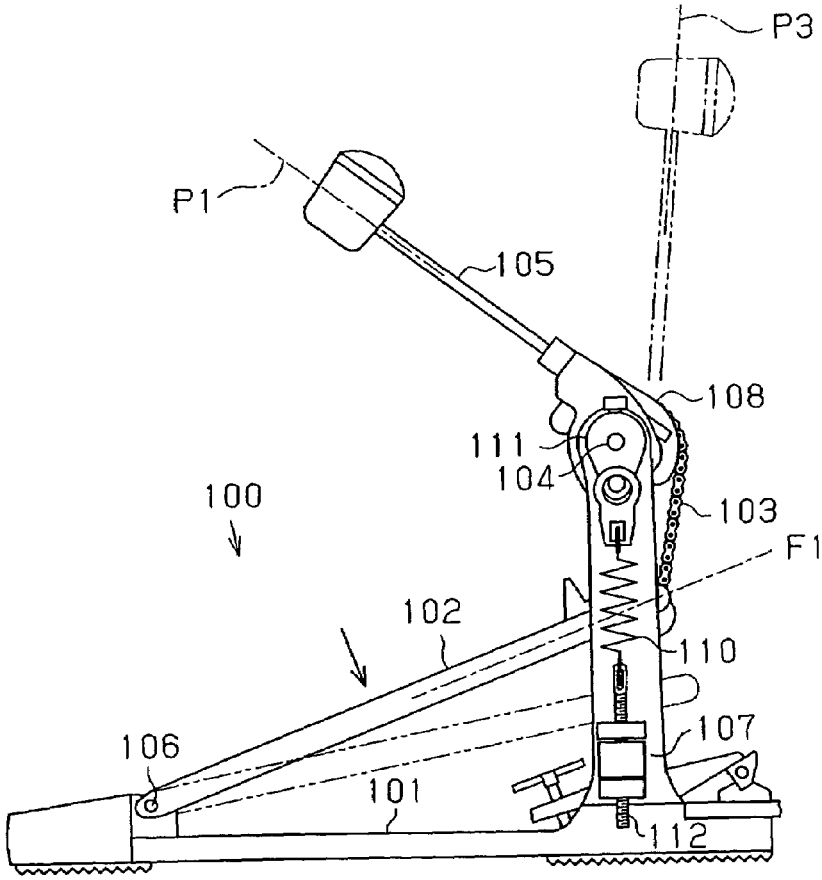
Fig.11 (Prior Art)
FIG. 11 is a side view showing a pedal device of the prior art.

Further, in the preferred embodiment, when the drummer frees the pedal 12, in addition to the urging force of the extension coil spring 35, the urging force of the compression coil spring 50 is directly applied to the pedal 12. This increases the urging force that returns the pedal 12 to the standby position F1. Accordingly, in comparison with the pedal device 100 of the prior art shown in FIG. 11, the return speed of the pedal 12 when the pedal 12 is freed is increased. Thus, even if the drummer quickly lifts his or her foot when releasing the pedal 12, the pedal 12 follows the movement of the drummer's foot. This gives the drummer a feel as if the pedal 12 is stuck to his or her foot. Accordingly, the pedal 12 quickly moves upward and downward in correspondence with the movement of the drummer's foot and makes the bass drum 5 easier to play.

The preferred embodiment has the advantages described below.

(1) The pedal device 10 is provided with the compression coil spring 50, which is located between the pedal 12 and the base plate 11. Thus, in addition to the urging force of the extension coil spring 35, the pedal 12 is urged by the urging force of the compression coil spring 50. This increases the return speed of the pedal 12 when the pedal 12 is freed. As a result, even if the drummer quickly lifts his or her foot from the pedal 12 when successively beating the bass drum 5, the pedal 12 remains in contact with the drummer's foot. Thus, the pedal 12 follows the movement of the drummer's foot and makes the drum easier to play.

(2) If the compression coil spring 50 were to have an excessively strong urging force, the return speed of the pedal 12 may become too fast and loosen the chain 13. This may greatly affect the movability of the pedal device 10 in an undesirable manner. However, in the preferred embodiment, the urging force of the compression coil spring 50 is set to be less than the load produced by the pedal 12. This prevents the return speed of the pedal 12 from becoming excessively high so as not to hinder with the playing of the bass drum 5.

(3) When the pedal 12 is in a free state and not depressed, the compression coil spring 50 is spaced from the lower surface 12*b* of the pedal 12 so that the upper end 50*a* of the compression coil spring 50 does not contact the pedal 12. Thus, when the depression of the pedal 12 starts, the urging force of the compression coil spring 50 is not applied to the pedal 12 since the upper end 50*a* of the compression coil spring 50 is not in contact with the pedal 12. This prevents the addition of the compression coil spring 50 from increasing the force required to depress the pedal 12. Accordingly, the addition of the compression coil spring 50 does not affect the movability of the pedal 12.

(4) The compression coil spring 50 is arranged so that its axis C1 is perpendicular to the upper surface 12*a* of the pedal 12 when the pedal 12 is depressed by the maximum amount and the beater 15 is located at the operation position P3. Accordingly, when the compression coil spring 50 is most compressed, the urging force of the compression coil spring 50 is further effectively applied to the pedal 12.

(5) The compression coil spring 50 is located at the generally middle part of the base plate 11 with respect to the lateral and longitudinal directions. In this case, when the pedal 12 compresses the compression coil spring 50 from the upper side, the upper end 50*a* of the compression coil spring 50 contacts the generally middle part of the pedal 12. Thus, the urging force of the compression coil spring 50 is further effectively applied to the pedal 12.

(6) The compression coil spring 50 is detachably fitted to the upper end of the boss 55. Thus, the compression coil spring 50 may be attached and detached as required. Further, the compression coil spring 50 may be exchanged with a spring having a different spring constant. This increases the versatility and product value of the pedal device 10.

It should be apparent to those skilled in the art that the present invention may be embodied in many other specific forms without departing from the spirit or scope of the invention. Particularly, it should be understood that the present invention may be embodied in the following forms.

In the preferred embodiment, the compression coil spring 50 is used as an elastic member. However, any member exerting an urging force may be used such as a leaf spring, a sponge, and a rubber member.

Figure 6:
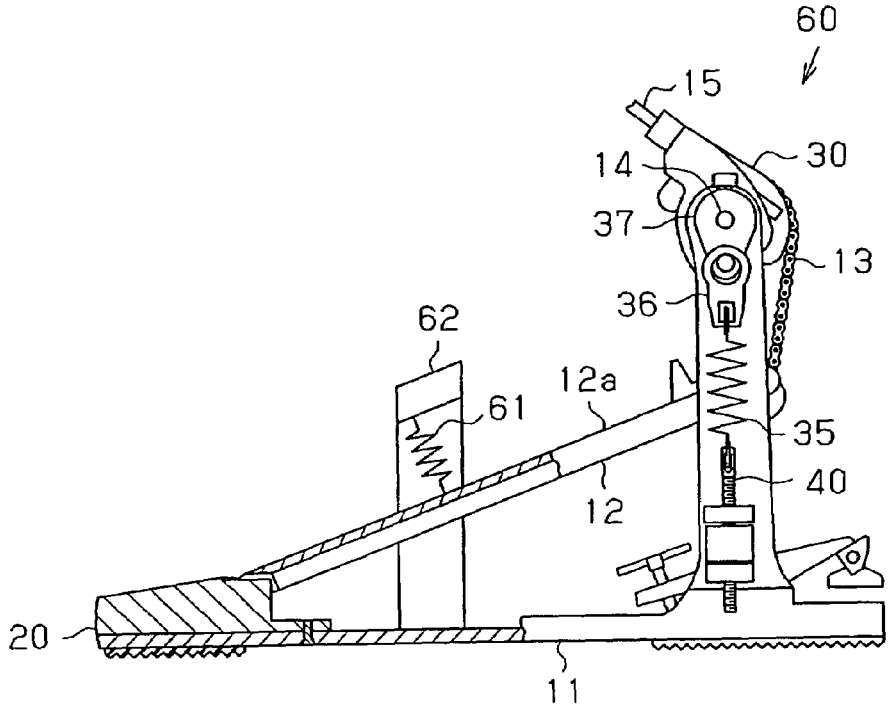
FIG. 6 is a partially cutaway cross-sectional view showing a modification of the attachment structure for the compression coil spring.

In the preferred embodiment, instead of the compression coil spring 50, a pedal device may have an extension coil spring arranged above the pedal 12. One example of such a pedal device is shown in FIG. 6. As shown in the drawing, an arm 62 extends from the generally middle part of the base plate 11. The extension coil spring 61 has one end connected to an upper end portion of the arm 62 and another end connected to the upper surface 12*a* of the pedal 12. Further, in the pedal device 60 of FIG. 6, the compression coil spring 50 of FIG. 4 may be additionally arranged between the pedal 12 and the base plate 11.

The preferred embodiment may be modified so that the upper end 50*a* of the compression coil spring 50 contacts the pedal 12 even when the pedal 12 is not depressed. This would also increase the return speed of the pedal 12.

Figure 7:
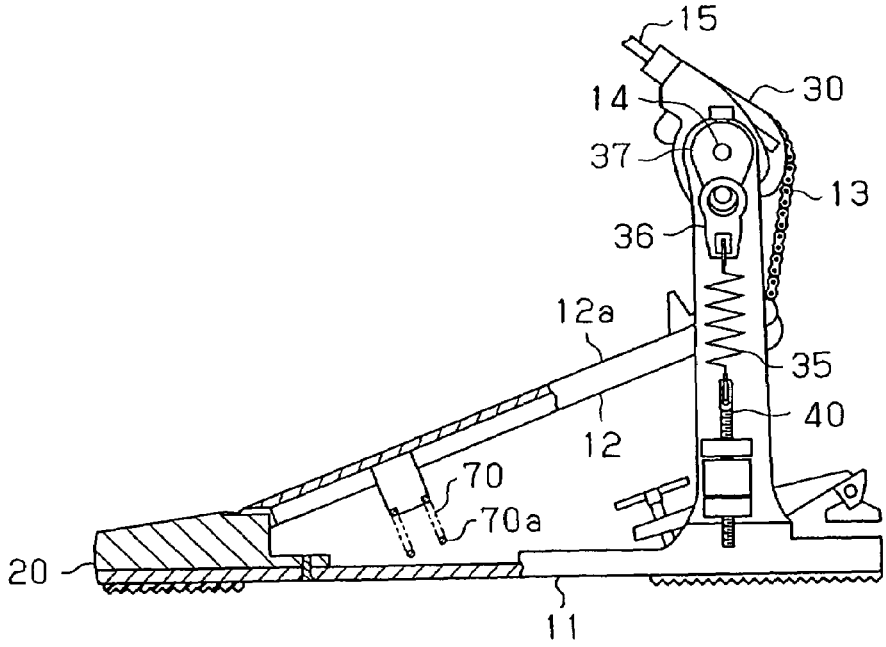
FIG. 7 is a partially cutaway cross-sectional view showing another modification of the attachment structure for the compression coil spring.

In the preferred embodiment, the compression coil spring 50 is attached to the base plate 11. However, as shown in FIG. 7, the compression coil spring 70 may be attached to the pedal 12 instead. In such a case, it is preferred that the lower end 70*a* of the compression coil spring 70 does not contact the upper surface of the base plate 11 when the pedal 12 is not depressed.

In the preferred embodiment, the compression coil spring 50 may be located at any position. This would also increase the return speed of the pedal 12.

Figure 8:
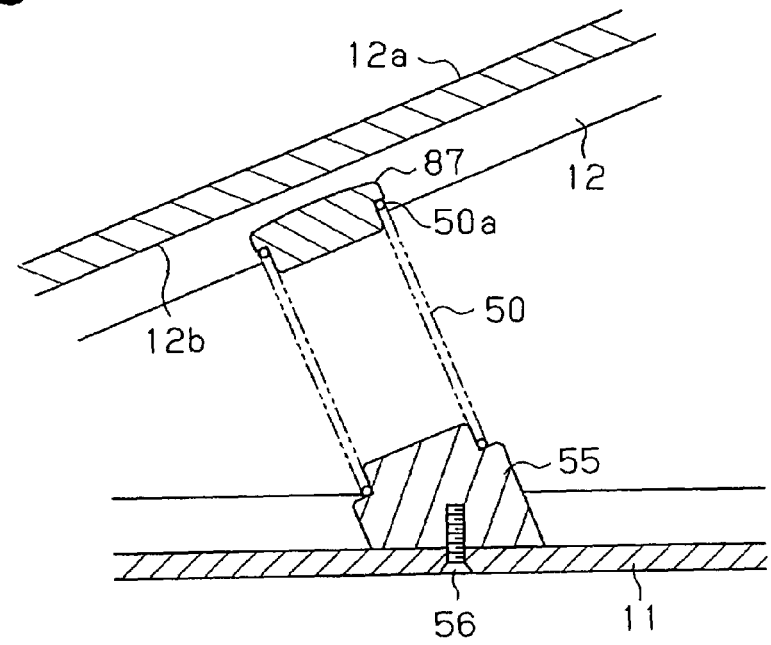
FIG. 8 is a partially enlarged cross-sectional view showing a modification of an absorber.

In the preferred embodiment, the sheet-shaped absorber 57 is adhered to the lower surface of the pedal 12. Instead, as shown in FIG. 8, an absorber 87 may be attached to the compression coil spring 50 so as to cover the upper end 50*a* of the compression coil spring 50. In this case, the absorber 87 is a round plate having a curved surface and made of a material having a cushioning property.

In the preferred embodiment, the boss 55 may be eliminated, and the compression coil spring 50 may be directly fixed to the base plate 11.

Figure 9:
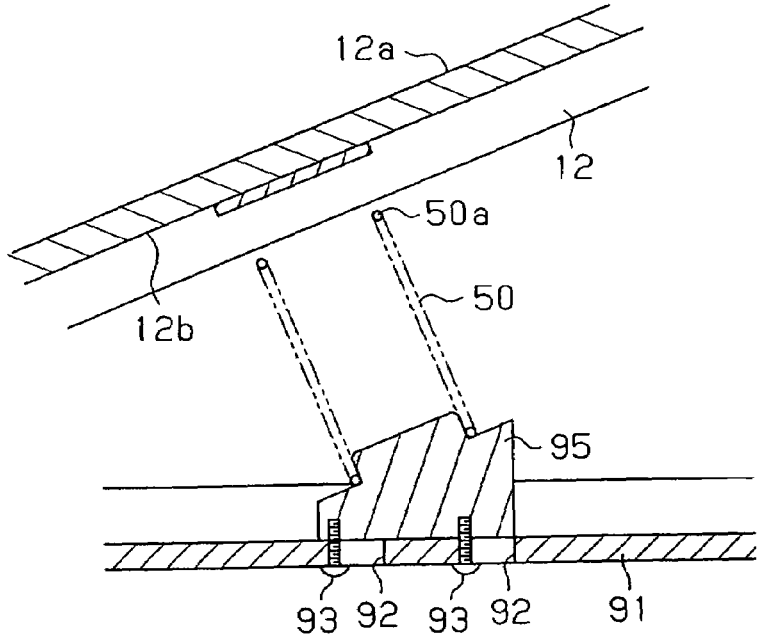
FIG. 9 is a partially enlarged cross-sectional view showing a further modification of the attachment structure for the compression coil spring.
Figure 10:
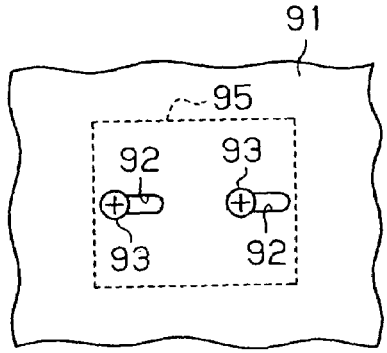
FIG. 10 is an enlarged partial bottom view of the attachment structure shown in FIG. 9.

Further, as shown in FIGS. 9 and 10, elongated holes 92 may be formed in a longitudinal direction of a base plate 91, and a boss 95 may be movably arranged along the elongated holes 92. In such a case, the base plate 91 has two elongated holes 92. A fastening screw 93 is inserted through each elongated hole 92 and fastened to the upper surface of the base plate 91. This enables fine adjustment of the position at which the urging force of the compression coil spring 50 is applied to the pedal 12 and fine adjustment of the magnitude of urging force applied to the pedal 12. This further increases the versatility and product value of the pedal device 10.

In the preferred embodiment, the wheel 30 and the pedal 12 are connected by a chain 13. However, a link mechanism functioning as a structure connecting the wheel 30 and the pedal 12 may be employed. In such a link mechanism, loosening would not occur such as when the chain 13 is used. Thus, even when using a compression coil spring 50 having a strong urging force, an excessively high return force for the pedal 12 would not greatly affect the movability of the pedal device 10.

Further, in the preferred embodiment, when the pedal 12 returns to the standby position F1, the urging force of the compression coil spring 50 is added in an auxiliary manner to the urging force of the extension coil spring 35. However, by employing a link mechanism, the tolerable range of the compression coil spring 50 may be enlarged. More specifically, the urging force of the extension coil spring 35 may be added in an auxiliary manner to the urging force of the compression coil spring 50 by increasing the urging force of the compression coil spring 50 or decreasing the urging force of the extension coil spring 35. Alternatively, the urging force of the extension coil spring 35 and the urging force of the compression coil spring 50 may be about the same.

The present examples and embodiments are to be considered as illustrative and not restrictive, and the invention is not to be limited to the details given herein, but may be modified within the scope and equivalence of the appended claims.

What is claimed is:

1. A pedal device used to play a drum, the pedal device comprising:

a base;

a beater pivotally supported by the base and configured to pivot between an operation position for beating the drum and a suspended position separated from the drum;

a pedal pivotally supported by the base and configured to operate the beater, the pedal being located at a standby position that is separated from the base when in a free state and being located at a position that is close to the base when in a depressed state;

a connection member configured to connect the pedal and the beater;

a first urging member configured to hold the beater at the suspended position and the pedal at the standby position when the pedal is in the free state, the beater being positioned and configured to be pivoted from the suspended position to the operation position against an urging force of the first urging member when the pedal is depressed, the urging force of the first urging member returning the beater to the suspended position from the operation position and the pedal to the standby position when the pedal is freed from the depressed state; and a second urging member attached to the base and configured to urge the pedal away from the base by adding a second urging force in an auxiliary manner to the urging force of the first urging member when the beater returns to the suspended position, wherein the second urging force of the second urging member is smaller than a load produced by the pedals, the base being configured such that the second urging member is slidable along a longitudinal direction of the base to adjust a longitudinal position of the second urging member to control the second urging force.

2. The pedal device according to claim 1, wherein the second urging member is positioned between the base and the pedal and is configured to apply the urging force to the pedal and to move the pedal away from the base when the beater is located at the operation position.

3. The pedal device according to claim 1, wherein the second urging member is spaced from the pedal when the pedal is located at the standby position.

4. The pedal device according to claim 3, wherein the first urging member is an extension coil spring, and the second urging member is a compression coil spring.

5. The pedal device according to claim 4, wherein the compression coil spring has an axis that is perpendicular to the pedal when the beater is located at the operation position.

6. The pedal device according to claim 5, wherein the compression coil spring has a lower end attached to the base and an upper end spaced from the pedal when the pedal is in the free state.

7. The pedal device according to claim 6, wherein the upper end of the compression coil spring faces toward a middle part of the pedal with respect to a longitudinal direction of the pedal.

8. The pedal device according to claim 6, wherein the compression coil spring is detachably attached to the base.

9. The pedal device according to claim 6, wherein the upper end of the compression coil spring faces toward a middle part of the pedal with respect to a lateral direction of the pedal.

10. The pedal device according to claim 6, wherein an absorber is arranged on the pedal at a position facing toward the upper end of the compression coil spring.

11. The pedal device according to claim 6, wherein an absorber is attached to the compression coil spring so as to cover the upper end of the compression coil spring.

12. In combination the pedal device used to play the drum according to claim 1, and the drum.

13. The pedal device according to claim 1, further comprising an absorber positioned on the second urging member.

14. The pedal device according to claim 1, the base comprising an elongate hole configured to receive a fastening member for securing the second urging member to the base such that the second urging member is adjustable in the longitudinal position by sliding the fastening member in the elongate hole.

* * * * *